United States Patent [19]

Castwall et al.

[11] Patent Number: 4,991,247

[45] Date of Patent: Feb. 12, 1991

[54] METHOD OF BALANCING A CONTAINER WHICH ROTATES ABOUT AN ESSENTIALLY HORIZONTAL AXIS

[75] Inventors: Lennart W. Castwall, Täby, Sweden; Jorma K. Poikonen, Naantali; Pekka O. Alkuvaara, Turku, both of Finland

[73] Assignee: Aktiebolaget Electrolux, Stockholm, Sweden

[21] Appl. No.: 460,188

[22] PCT Filed: May 23, 1989

[86] PCT No.: PCT/SE89/00288

§ 371 Date: Feb. 5, 1990

§ 102(e) Date: Feb. 5, 1990

[87] PCT Pub. No.: WO89/12132

PCT Pub. Date: Dec. 14, 1989

[30] Foreign Application Priority Data

May 30, 1988 [SE] Sweden ..... 8802011

[51] Int. Cl.[5] ..... D06F 37/22

[52] U.S. Cl. ..... 8/158; 68/23.2; 74/573 F; 210/144

[58] Field of Search ..... 8/158, 159; 68/12 R, 68/23.2; 210/144; 74/573 F

[56] References Cited

U.S. PATENT DOCUMENTS

| | | | |
|---|---|---|---|
| 3,066,522 | 12/1962 | Steinmuller | 68/23.2 |
| 3,117,926 | 1/1964 | Starr et al. | 68/12 R X |
| 4,517,695 | 5/1985 | Hoffmann et al. | 68/12 R X |
| 4,688,355 | 8/1987 | Menigat et al. | 74/573 F X |
| 4,905,419 | 3/1990 | Makarov et al. | 74/573 F X |

FOREIGN PATENT DOCUMENTS

| | | | |
|---|---|---|---|
| 0914685 | 3/1982 | U.S.S.R. | 68/23.2 |

*Primary Examiner*—Philip R. Coe

*Attorney, Agent, or Firm*—Pearne, Gordon, McCoy & Granger

[57] ABSTRACT

According to a method of balancing a container (10) which is rotating about an essentially horizontal axis, preferably a washing machine drum, the container is provided with cavities (15) evenly distributed along the periphery thereof and having openings (20) via which selectively liquid can be introduced in the respective cavity. A sensor (24) is provided for sensing vibrations caused by the rotation of the container and for emitting an electrical signal the magnitude of which is a measure of the magnitude of the vibrations. The container (10) is brought to rotate at a first rotational speed and the sensor signal is read. A predetermined amount of liquid is introduced in a randomly selected cavity (15) along the periphery of the drum. The sensor signal is again read and the value is compared with the preceding sensed value, wherein if the value is lower than the preceding one a new dose of the predetermined amount is introduced in the selected cavity while if the value is equal to or greater than the preceding one the predetermined amount is introduced in the immediate following cavity along the periphery. The described sequence is repeated until the sensor signal is lower than a predetermined, permissible value at which the container is brought to rotate at a second rotational speed, higher than the first one. The sequence described is repeated for different rotational speeds until the desired rotational speed has been reached and the sensor signal is lower than the predetermined value.

6 Claims, 1 Drawing Sheet

METHOD OF BALANCING A CONTAINER WHICH ROTATES ABOUT AN ESSENTIALLY HORIZONTAL AXIS

The present invention refers to a method of balancing a container which rotates about an essentially horizontal axis.

In washing and spin-drying machines the laundry represents rotating masses which are never exactly balanced with respect to the axis of rotation of the rotating container, such as a drum or the like, in which the laundry is placed. Accordingly, as a rule an essential imbalance, static and dynamic, develops which results in a radial force which rotates about the axis of rotation and a torque which turns with the rotating axis and which is situated in a plane through the said axis. The rotating force and torque, respectively, are causing oscillations and vibrations involving substantial problems in the construction of a washing or a spin-drying machine which has to resist the strain thus developed.

The problems referred to occur as the rotating container is operated at a high spinning speed and also when, during acceleration up to said spinning speed, a speed value is being passed through which is critical for the rotating system and at which the oscillations and vibrations have a maximum amplitude.

In U.S. Pat. No. 3,117,926 there is disclosed a device for equilibration of the imbalance of forces as they occur. In the publication a washing machine is described wherein a rotating drum has been provided with cavities evenly distributed along the periphery thereof and in which water can be introduced to compensate for the imbalance caused by the unevenly distributed laundry. In the washing machine there is required a sensing device for indicating the magnitude and position, respectively, of the imbalance in the rotating drum. Moreover, a device is required which in dependence on information from the sensing device introduces the correct amount of water, in the right cavity. By necessity, the control system used will become complicated and cost demanding.

Primarily, the object of the invention is to remedy the drawbacks indicated and to provide a method by which a sensing device for sensing the magnitude and position of the imbalance can be replaced by a simplified device which only has to indicate the instantaneous magnitude of the imbalance.

Another object of the invention is to provide a method for equilibration of imbalanced forces resulting in a more rapid correction of an indicated imbalance allowing a substantial increase of the maximum permissible spinning speed.

The objects indicated are achieved by the use of a method having the characteristic measures indicated below. Preferred method steps are also indicated below.

The invention will now be described in detail in connection with an embodiment with reference to the enclosed drawings.

FIG. 1 schematically shows a washing machine drum with a balancing device in a side view.

Figure 4:
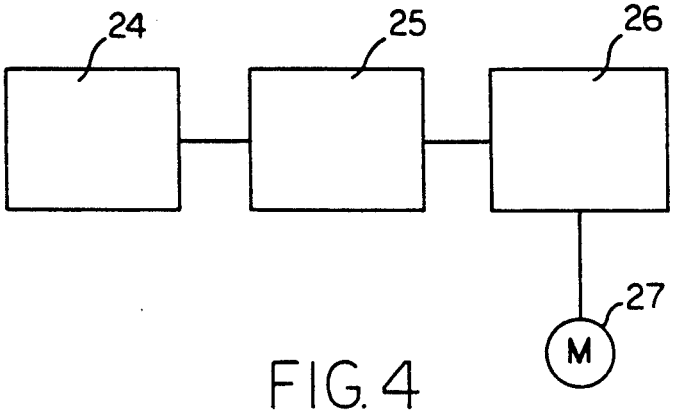

FIG. 4, finally, is a simple block diagram for a balancing device for carrying out the method of the invention.

Figure 2:
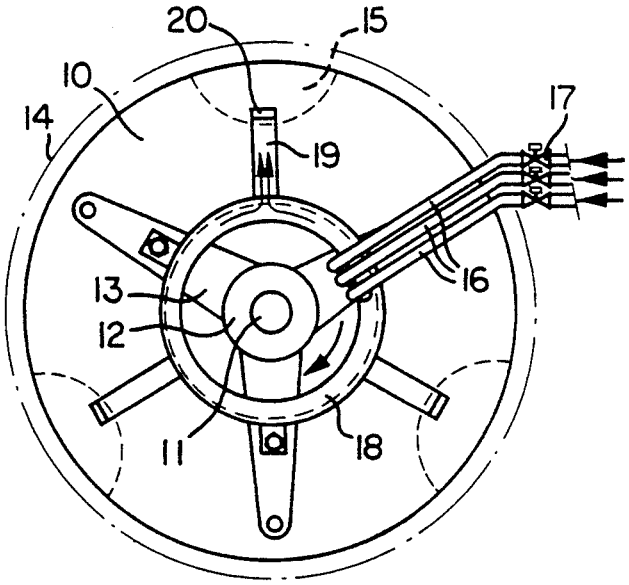
FIG. 2 is a right hand side view of the drum according to FIG. 1.
Figure 3:
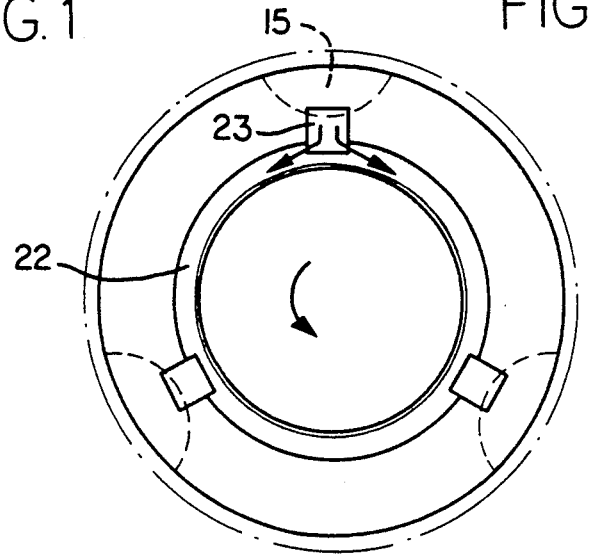
FIG. 3 is a left hand side view of the drum of FIG. 1.

In the embodiment to be described below a washing machine drum 10 is journalled for rotation about an essentially horizontal rotation axis 11. The drum, which is to be used in a front-load washing machine, is open at its left side in FIG. 1 for making possible the loading of the laundry. At its opposite side the drum is journalled in a bearing 12 mounted in an end shield 13 which with a tub 14 forms an integral unit. The tub encloses the drum 10 and is only faintly outlined in FIGS. 1-3.

Figure 1:
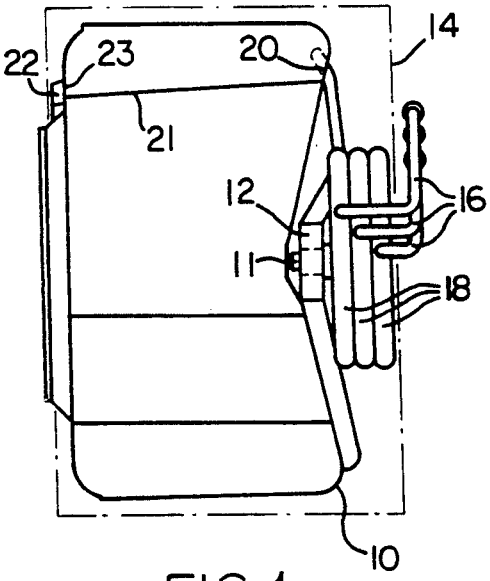

The drum 10 has three containers 15 which are situated at the periphery thereof and to which water can be supplied for equilibration of any drum imbalance that may occur. The containers are evenly distributed along the periphery of the drum, i.e. with a pitch of 120 degrees. For the supply of water to the containers via solenoid valves 17 three water tubes 16, one for each container, are connected to a water supply system. Each of the water tubes 16 opens in front of an open annular ring 18 which rotates with the drum and which via a channel 19 is connected with its respective container. As shown in FIG. 1 liquid is introduced in the container 15 via an opening 20 in the right end wall thereof, the said opening being positioned adjacent to that of the boundary walls of the container which is closest to the rotational axis. Draining of the containers can be effected via a ring 22 which is similar to the rings 18, however, situated at the open end of the drum surrounding the loading opening. The container is connected to the ring 22 via an opening 23 situated at essentially the same level in the container as the opening 20. The position chosen for the opening 23 in the container results in that water can be drained from the container when the drum has stopped in the position shown in FIG. 1. Draining can also take place when the drum is rotating slowly. In case of the drum rotating at high speed the liquid in the container will be forced towards the periphery of the drum and will therefore be kept in the container.

The method of balancing according to the invention will now be desribed. It is assumed that the drum 10 has been loaded with laundry and that an automatic wash program including a wash phase, a rinse phase and a spin phase has been carried out up to the point where the spin phase only is left.

An essential feature of the invention is that the drum is not accelerated up to the final spinning speed in one single step but in several steps where in each step balancing is performed and where the next step is not effected until the imbalance is below a predetermined value. In the example eight steps have been chosen corresponding to the following spinning speeds:

$n_1 = 124$ rpm
$n_2 = 175$ rpm
$n_3 = 240$ rpm
$n_4 = 330$ rpm
$n_5 = 460$ rpm
$n_6 = 635$ rpm
$n_7 = 880$ rpm
$n_8 = 1200$ rpm.

In each step balancing is carried out by introduction of a predetermined amount of water in one of the containers 15. The predetermined amount is measured by opening of one of the solenoid valves during a predetermined time period. In the same way the container to be supplied is determined by the solenoid valve that is operated. The magnitude of the imbalance is determined by a vibration sensor which can be designed in various ways. In the example a vibration sensor 24 (FIG. 4) has been used in which a voltage is generated which represents the magnitude of the imbalance. The vibration sensor of the example has been manufactured by the company Carl Schenk AG under the name "Vibrometer 20". The sensor voltage is applied to a microcomputer 25 which performs the required comparison between the measurement values, respectively, from the sensor prior to and after the introduction of water in any of the containers and, in addition, between the measurement value and a predetermined reference value representing the highest permissible imbalance. This reference value can be different for the different spinning speeds $n_1$–$n_8$. The microcomputer emits control signals which are applied to a control unit 26. This unit controls a spinning motor 27 which drives the washing machine drum 10 and is of the DC motor type.

A typical balancing operation can be carried out in the following way. The microcomputer activates one of the solenoid valves 17 during a predetermined time period in order for the predetermined amount of water to be introduced in the corresponding container 15 via the water tube 16, the ring 18, the channel 19 and the opening 20. Then, the signal from the vibration sensor is read and the microcomputer determines if the imbalance has declined as a result of the predetermined amount of water introduced in the container. If positive, another dose of the predetermined amount of water is introduced in the same container and a new determination is made by the microcomputer. The operation is repeated unil no further reduction of the imbalance can be registered. In a next step the microcomputer activates the next solenoid valve so that the predetermined amount of water is introduced in the next container which is being filled repeatedly until also here no further reduction of the imbalance can be registered. The operation is then repeated for the remaining container and so again for the other ones until the value read from the vibration sensor is below the predetermined reference value corresponding to the highest permissible imbalance. After that, a signal is applied to the control unit 26 to control the motor 27 to the next higher spinning speed. In the way described the balancing operations are repeated for each spinning speed until the highest speed has been switched in and balancing has been performed. The comparison between the actual measurement value and the reference value corresponding to the highest permissible imbalance takes place regularly as the comparison is carried out between the measurement values prior to and after a filling sequence. The switching-in of the next higher spinning speed takes place as soon as the measurement value is lower than the reference value. This may happen already after the introduction of the first dose in the first container.

According to a modified method, in addition to the comparasion between the measurement values from the vibration sensor prior to and after the introduction of the predetermined amount of water, respectively, in a container another comparison can be made. This comparison is made between the measurement value taken after the said introduction of the predetermined amount of water and the lowest measurement value read during the complete prior balancing operation. Then, a further criterion for another dose of the predetermined amount of water to be introduced in the actual container will be that the additional comparison does not indicate an increase of the measurement value. This means that the last measurement value can be less than or equal to the lowest measurement value during the prior part of the balancing operation.

In the microcomputer a further reference value has been stored which is a limit value corresponding to an imbalance which may involve risks for the oscillating system. During each balancing operation a comparison between the measurement value from the vibration sensor and the limit value also takes place repeatedly. In case the limit value is exceeded the motor 27 is stopped and the containers are emptied either by each of the containers, one at a time, during a suitable time period taking the position shown in FIG. 1 or by rotating the drum at a low speed. The containers are always emptied prior to each spinning phase and suitably also after such phase. In case the limit value has been exceeded and the containers drained also the tub 14 of the machine is drained before the drum is again driven up to the lowest spinning speed.

The described balancing method can be used in automatic washing machines and spin dryers having various types of control devices. The microcomputer used in the example may be replaced by standard logic circuits or by a micro circuit which has been designed especially for this purpose. In addition the vibration sensor 24 can be replaced by an imbalance detector of any other kind. For example, changes in the motor current caused by the imbalance can be used for determining of the magnitude of said imbalance.

Summarizing, in practical tests the balancing method described has shown to result in such low values of the imbalance that the spinning speed could be increased substantially without any risks of unpermissible strain on the parts of the machine supporting the oscillating system comprising the tub and the rotating drum.

We claim:

1. A method of balancing a container which rotates about an essentially horizontal axis (11), the container being provided with cavities (15) which are evenly distributed along the periphery thereof and have openings (20) via which selectively liquid can be introduced into the respective cavities, a sensor (24) being provided which senses vibrations caused by the rotation of the container and which emits an electrical signal the magnitude of which is a measure of the magnitude of the vibrations, characterized by the following steps:

the container (10) is brought to rotate at a first rotational speed and the sensor signal is read, a predetermined amount of liquid is introduced in a randomly selected cavity (15) along the periphery of the container, the sensor signal is again read and the value is compared with the previously read value, if the value is lower than the previous one another dose of the predetermined amount of liquid is introduced in the selected cavity, while if the value is equal to or greater than the previous value the predetermined amount is introduced in the cavity that is next to follow along the said periphery, the sequence of successive filling of liquid in the different cavities, and reading of the sensor signal is repeated until the sensor signal is lower than a predetermined, permissible value, the container (10) is brought to rotate at a second rotational speed, greater than the first one, the sequence of alternate filling of liquid in the different cavities, reading of the sensor signal and comparing of the actual value with the previous one is repeated for the different rotational speeds until the desired highest rotational speed has been reached and the sensor signal has a value lower than the predetermined permissible value.

2. Method according to claim 1, characterized in that prior to starting of a rotation operation the cavities (15) distributed along the periphery of the container are emptied of liquid.

3. Method according to claim 2, characterized in that the cavities (15) are emptied of liquid prior to as well as after a rotation operation.

4. Method according to claim 1, characterized in that one measurement value, the limit value, of the sensor signal corresponding to the greatest permissible imbalance is determined, that during the rotation operation the sensor signal is repeatedly compared with the limit value, that if the limit value is exceeded the rotation operation is interrupted and all cavitites are emptied of liquid, and that a new rotation operation is initated.

5. Method according to claim 1, characterized in that measurement values of the sensor signal are repeatedly read during periods $(T_x+T_y)$, where $T_x$ is the time period in which a dose of the predetermined amount is introduced in a cavity and $T_y$ is the time period between two successive fillings, that the lowest value in each period is stored, that each such lowest measurement value in a first comparison is compared with the lowest measurement value in the immediately preceding time period, and that each such measurement value in a second comparison is compared with the lowest measurement value achieved during a time comprising all periods, the condition for another dose to be introduced in a cavity (15) after a first dose of the predetermined amount has been introduced in the said cavity being dependent on the first comparison indicating a decrease of the sensor signal and at the same time the second comparison does not indicate an increase of the sensor signal.

6. A method according to claim 5, characterized in that the second comparison is carried out only at lower rotational speeds.

* * * * *